US006647213B2

(12) United States Patent
Takeda

(10) Patent No.: US 6,647,213 B2
(45) Date of Patent: Nov. 11, 2003

(54) IMAGE FORMING APPARATUS HAVING A MODE IN WHICH A PROCESS UNIT MAY BE REPLACED

(75) Inventor: Kazuhisa Takeda, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/998,062

(22) Filed: Nov. 30, 2001

(65) Prior Publication Data

US 2003/0103773 A1 Jun. 5, 2003

(51) Int. Cl.[7] ..... G03G 15/00
(52) U.S. Cl. ..... 399/12; 399/25
(58) Field of Search ..... 399/12, 24, 25, 399/26, 27, 82

(56) References Cited

U.S. PATENT DOCUMENTS 5,740,491 A * 4/1998 Imai ..... 399/25
5,822,646 A * 10/1998 Kinoshita et al. ..... 399/24

FOREIGN PATENT DOCUMENTS

JP 2-135374 A 5/1990

* cited by examiner

*Primary Examiner*—Joan Pendegrass
(74) *Attorney, Agent, or Firm*—Frishauf, Holtz, Goodman & Chick, P.C.

(57) ABSTRACT

In an image forming apparatus, a replaceable process unit which holds a photosensitive body and a device to form at least one image can be held in a holding section. The image forming apparatus counts an amount of use of the process unit and stores a count value in a storage section. When the image forming apparatus performs a printing operation, the apparatus determines whether a mode selectively set by a mode setting section is a first mode in which a printing operation stops when the count value reaches a given value or a second mode in which the printing operation does not stop when the count value reaches the given value.

38 Claims, 6 Drawing Sheets

IMAGE FORMING APPARATUS HAVING A MODE IN WHICH A PROCESS UNIT MAY BE REPLACED

BACKGROUND OF THE INVENTION

1. Field of the Invention

The present invention relates to an image forming apparatus that is capable of replacing a process unit holding a device for use in image forming and the like and a method of operating the image forming apparatus.

2. Description of the Related Art

In an image forming apparatus, the number of printed sheets is counted. When the count number reaches a preset number, a message to urge a user to replace a process unit is displayed on a display section of the image forming apparatus. An operator visually identifies the display and then places an order with an agency, which offers technical service of image forming apparatuses, for a new process unit. After the message is displayed, the image forming apparatus continues a printing operation until the count number reaches the preset number and stops it automatically when the count number exceeds the preset number. The image forming apparatus has a function of detecting that a new process unit is set and stopping a printing operation and resetting the count of the number of printed sheets when the operator inserts the new process unit.

If the above image forming apparatus continues being used after a message to replace a process unit is displayed and printing for the preset number of sheets until a new process unit is received, the apparatus will stop its printing operation. The user therefore has to keep a spare process unit to prevent the image forming apparatus from stopping a printing operation. Even though an old process unit to be replaced contains some parts of devices that are still usable, a user or a serviceman disposes of them together with the process unit. The costs per copy are increased accordingly.

BRIEF SUMMARY OF THE INVENTION

An object of the invention is to provide an image forming apparatus having some modes used for replacing a process unit and used widely to meet user's needs by setting the modes freely.

An image forming apparatus according to an aspect of the present invention comprises a replaceable process unit which holds a photosensitive body and a device to form at least one image, a holding section which holds the process unit, a storage section which counts an amount of use of the process unit and stores a count value, and a mode setting section which selectively sets a first mode in which a printing operation stops when the count value reaches a given value and a second mode in which the printing operation does not stop when the count value reaches the given value.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and comprise a part of the specification, illustrate presently embodiments of the invention, and together with the general description given above and the detailed description of the embodiments given below, serve to explain the principles of the invention.

DETAILED DESCRIPTION OF THE INVENTION

Embodiments of the present invention will now be described with reference to the drawings.

First Embodiment

Figure 1:
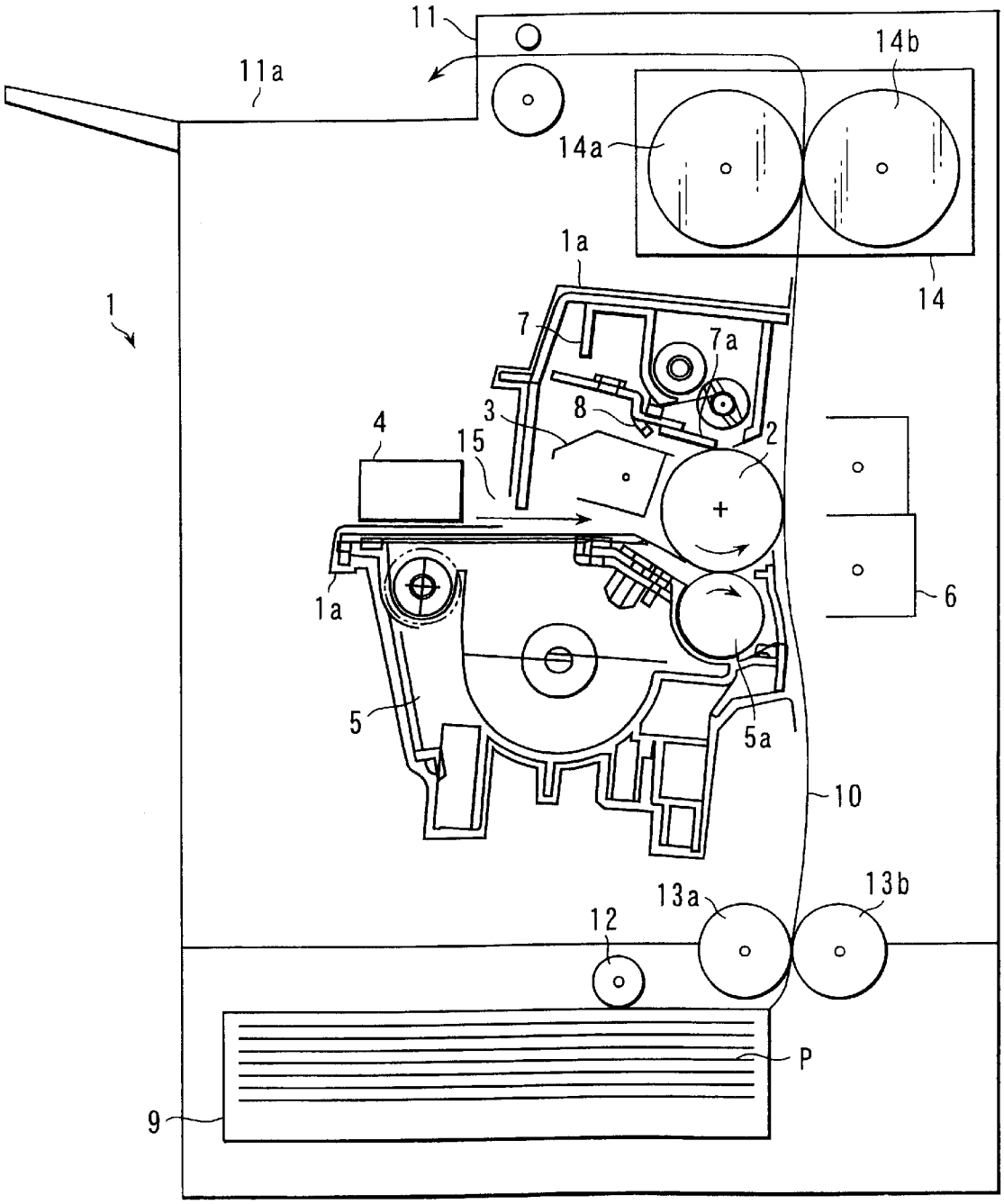
FIG. 1 is a schematic cross-sectional view showing a structure of an image forming apparatus according to a first embodiment.
Figure 2:
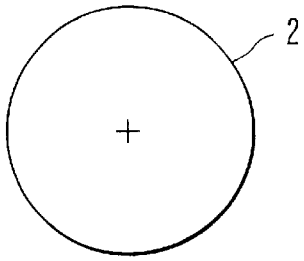
FIG. 2 is a view showing a photosensitive drum obtained by disassembling a process unit of the image forming apparatus according to the first embodiment.
Figure 3:
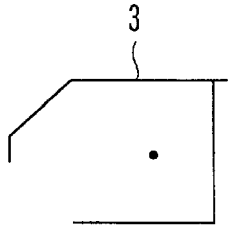
FIG. 3 is a view showing a charger obtained by disassembling a process unit of the image forming apparatus according to the first embodiment.
Figure 4:
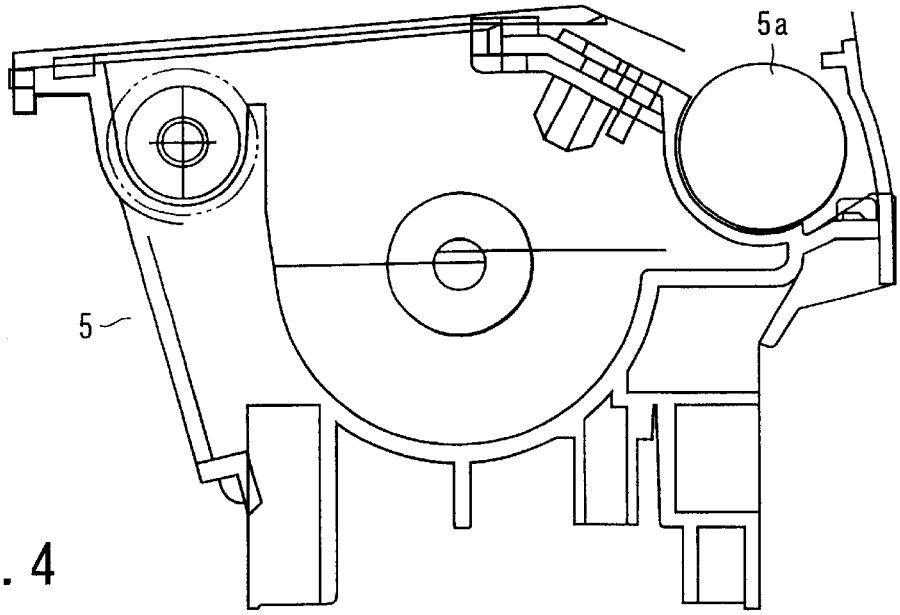
FIG. 4 is a view showing a developing unit obtained by disassembling a process unit of the image forming apparatus according to the first embodiment.
Figure 5:
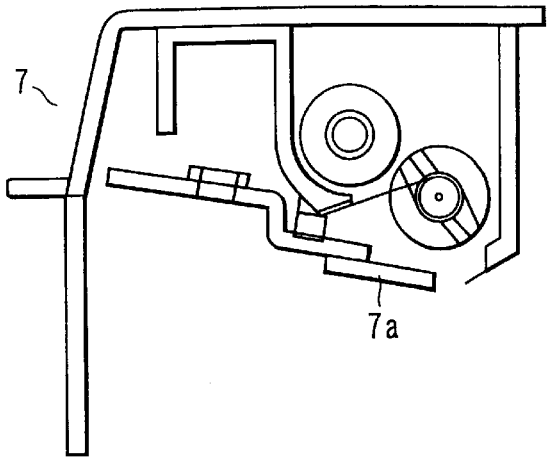
FIG. 5 is a view showing a cleaning unit obtained by disassembling a process unit of the image forming apparatus according to the first embodiment.

FIG. 1 is a schematic cross-sectional view showing a structure of an image forming apparatus 1 according to a first embodiment.

A photosensitive drum 2 that rotates counter-clockwise in the figure is provided in nearly the central part of the section of the image forming apparatus 1. A charger 3, an exposure unit 4, a developing unit 5, a transfer unit 6, a cleaning unit 7, and a discharge LED array 8 are arranged around the photosensitive drum 2.

Paper sheets P are contained in a drawable paper cassette 9 that is provided at the bottom of the image forming apparatus 1. A carrying path 10 for the paper sheets P extends from the paper cassette 9 to a paper discharge outlet 11 through between the photosensitive drum 2 and transfer unit 6 and through a fixing unit 14 arranged on the upper right side of the photosensitive drum 2. The paper sheets P discharged from the paper discharge outlet 11 are collected in a paper receiving section 11*a*. When the paper sheets P are sent to the carrying path 10 from the paper cassette 9 by a paper feed roller 12, they are supplied in between the photosensitive drum 2 and the transfer unit 6 by carrying rollers 13*a* and 13*b* between which the carrying path 10 is interposed.

The charger 3 uniformly charges the periphery of the photosensitive drum 2 with predetermined electrical charge.

The exposure unit 4 scans the periphery of the photosensitive drum 2 with a laser beam passing through a route indicated by the arrow in the figure and forms an electrostatic latent image.

The developing unit 5 supplies a developer from a developer-stored developer hopper to a developing roller 5*a* that rotates clockwise in the figure, and changes the electrostatic latent image on the photosensitive drum 2 to a developer image using the developer.

The transfer unit 6 transfers the developer image formed on the periphery of the photosensitive drum 2 to the paper sheets P.

The cleaning unit 7 cleans the developer off the periphery of the photosensitive drum 2 using a cleaning blade 7*a*.

The fixing unit 14 comprises a heat roller 14*a* including a heater and a pressure roller 14*b* and thermally fixes the developer image transferred to the paper sheets P by the transfer unit 6.

The image forming apparatus 1 forms an electrostatic latent image of an image to be printed on the periphery of the photosensitive drum 2 with a laser beam emitted from the exposure unit 4 while rotating the photosensitive drum 2 uniformly charged by the charger 3, and develops the electrostatic latent image using the developing unit 5. The image forming apparatus 1 rotates the paper feed roller 12 and carrying rollers 13*a* and 13*b* in synchronization with the development to carry the paper sheets P in between the photosensitive drum 2 and the transfer unit 6 and transfer the developer image on the paper sheets P. The image forming apparatus 1 thermally fixes the image-transferred paper sheets P by the fixing unit 14 and then discharged from the discharge outlet 11. Thus, the image forming apparatus 1 prints the image on the paper sheets P.

The photosensitive drum 2, charger 3, developing unit 5, and cleaning unit 7 are held in a process unit 15. The process unit 15 is held in a holding section 1*a* of the image forming apparatus 1 and can be removed from the holding section 1*a* and replaced. The process unit 15 removed from the image forming apparatus 1 can be disassembled for each of the photosensitive drum 2, charger 3, developing unit 5, and cleaning unit 7, as shown in FIGS. 2 to 5, and consumed parts of each of the units can be replaced.

Figure 6:
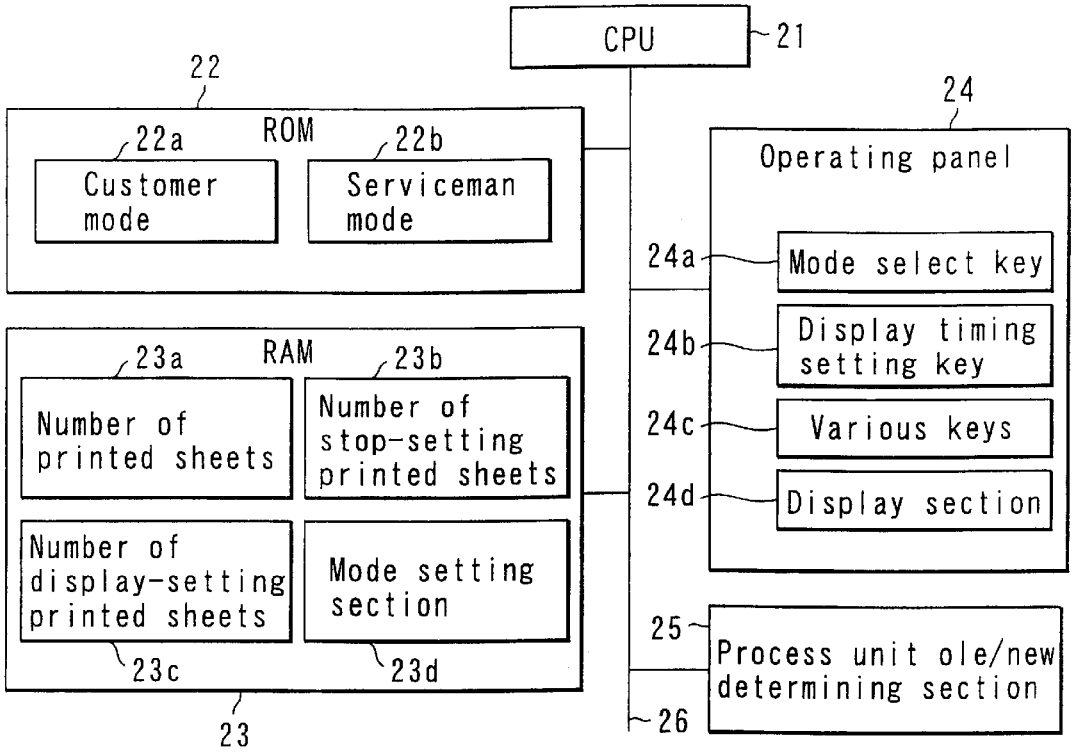
FIG. 6 is a diagram showing main control blocks of the image forming apparatus according to the first embodiment.

FIG. 6 is a diagram showing main control blocks of the image forming apparatus 1.

The image forming apparatus 1 includes a CPU (central processing unit) 21, a ROM (read-only memory) 22, a RAM (random-access memory) 23, an operating panel 24 serving as an operating unit, and a process unit old/new determining section 25. The CPU 21 is connected to the ROM 22, RAM 23, operating panel 24, and process unit old/new determining section 25 through a bus line 26.

The operating panel 24 arranges a mode select key 24*a*, a display timing setting key 24*b*, various keys 24*c* for making a setting, and a display section 24*d* to display a message for an operator.

The CPU 21 controls an operation of the image forming apparatus 1 as a main body of a controller.

The ROM 22 stores various programs that are executed by the CPU 21. The programs of the ROM 22 include two modes of a customer mode 22*a* as first mode and a serviceman mode 22*b* as second modes, respectively, for replacing the process unit 15.

The RAM 23 includes a work area for making various calculations by the CPU 11, an area for storing the number of printed sheets 23*a* as a count value for counting the amount of use of the process unit 15, an area for storing the number of stop-setting printed sheets 23*b* for setting the number of printed sheets that stop a printing operation of the main body, an area for storing the number of display-setting printed sheets 23*c* for setting the timing at which a process unit replacing message is displayed on the display section 24*d* by the number of printed sheets, and an area for a mode setting section 23*d* for setting the apparatus in either the customer mode 22*a* or the serviceman mode 22*b*. As the initial value, the number of display-setting printed sheets 23*c* is set smaller than the number of stop-setting printed sheets 23*b*.

In the customer mode 22*a*, when the number of printed sheets 23*a* exceeds the number of display-setting printed sheets 23*c*, a process unit replacing message is displayed on the display section 24*d*. After that, when it is detected that a new process unit 15 is inserted, the number of printed sheets 23*a* is automatically reset. The detection of the new process unit 15 will be described with reference to FIG. 7.

Figure 7:
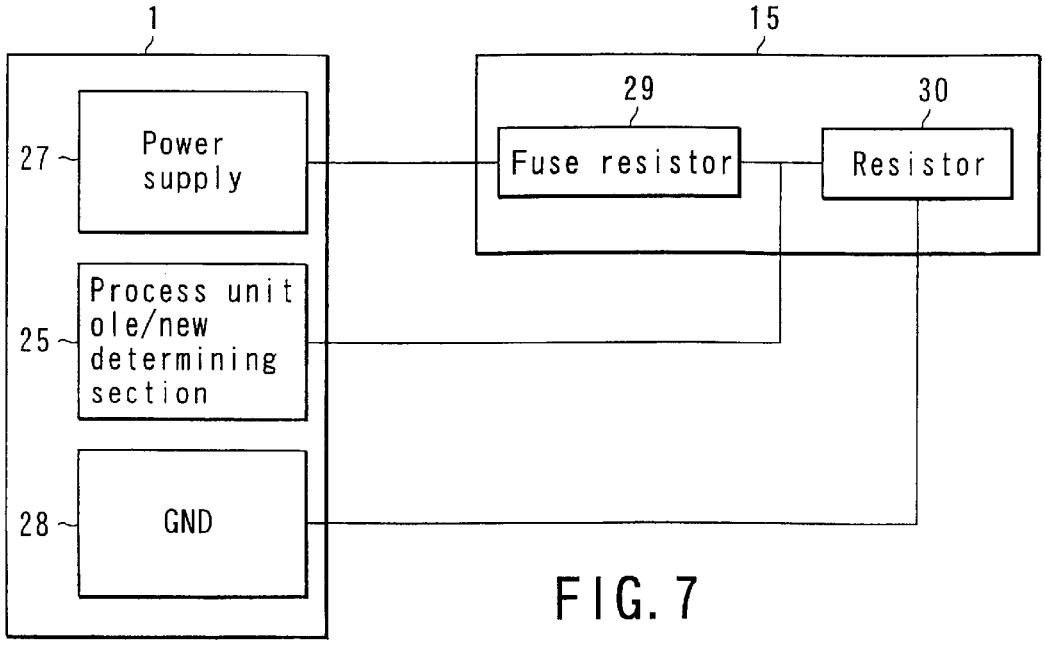
FIG. 7 is a diagram showing a structure for determining whether a process unit of the image forming apparatus according to the first embodiment is old or new.

FIG. 7 is a diagram showing a structure in which when a process unit 15 is inserted, the process unit old/new determining section 25 of the image forming apparatus 1 determines whether the process unit is a new one or an already-used one.

The image forming apparatus 1 includes a power supply 27 for supplying power, process unit old/new determining section 25, and GND (grounding) 28 for grounding the apparatus. The process unit 15 includes a Fuse resistor 29 and a resistor 30. When the process unit 15 is inserted in the image forming apparatus 1, the Fuse resistor 29 is connected to the power supply 27, and one of two lines branching off from the Fuse resistor 29 is connected to the resistor 30 while the other line is connected to the process unit old/new determining section 25. Further, the resistor 30 is connected to the GND 28 to be grounded.

When the process unit 15 is inserted in the image forming apparatus 1, the power supply 27 supplies power to the Fuse resistor 29. Since the resistor 30 is connected to the GND 28, a difference in potential occurs between the Fuse resistor 29 and resistor 30. Current therefore flows from the Fuse resistor 29 to the resistor 30 and process unit old/new determining section 25. If an excess of current flows, the Fuse resistor 29 generates heat. When the heat reaches a given temperature or higher, the line is disconnected to stop the current. If, therefore, a given amount of current flows, no current flows from the Fuse resistor 29 to the resistor 30 or the process unit old/new determining section 25.

In other words, when the process unit old/new determining section 25 detects a flow of current, it determines that a new process unit is inserted. When the process unit old/new determining section 25 does not detect any flow of current, it determines that a process unit has already been used.

In the customer mode 22*a*, a printing operation of the main body stops when the number of printed sheets 23*a* exceeds the number of stop-setting printed sheets 23*b*.

In the serviceman mode 22*b*, when the number of printed sheets 23*a* exceeds the number of display-setting printed sheets 23*c*, a process unit replacing message is displayed on the display section 24*d*. After that, the printing operation of the main body does not stop even though the number of printed sheets 23*a* exceeds the number of stop-setting printed sheets 23*b*. Furthermore, a serviceman can operate the operating panel 24 to reset the number of printed sheets 23*a*.

The customer mode 22*a* or the serviceman mode 22*b* can be set by the mode setting section 23*d* using the mode select key 23*a*.

The setting of the number of display-setting printed sheets 23*c* for displaying a process unit replacing message on the display section 24*d* can be changed by the display timing setting key 24*b*.

Figure 8:
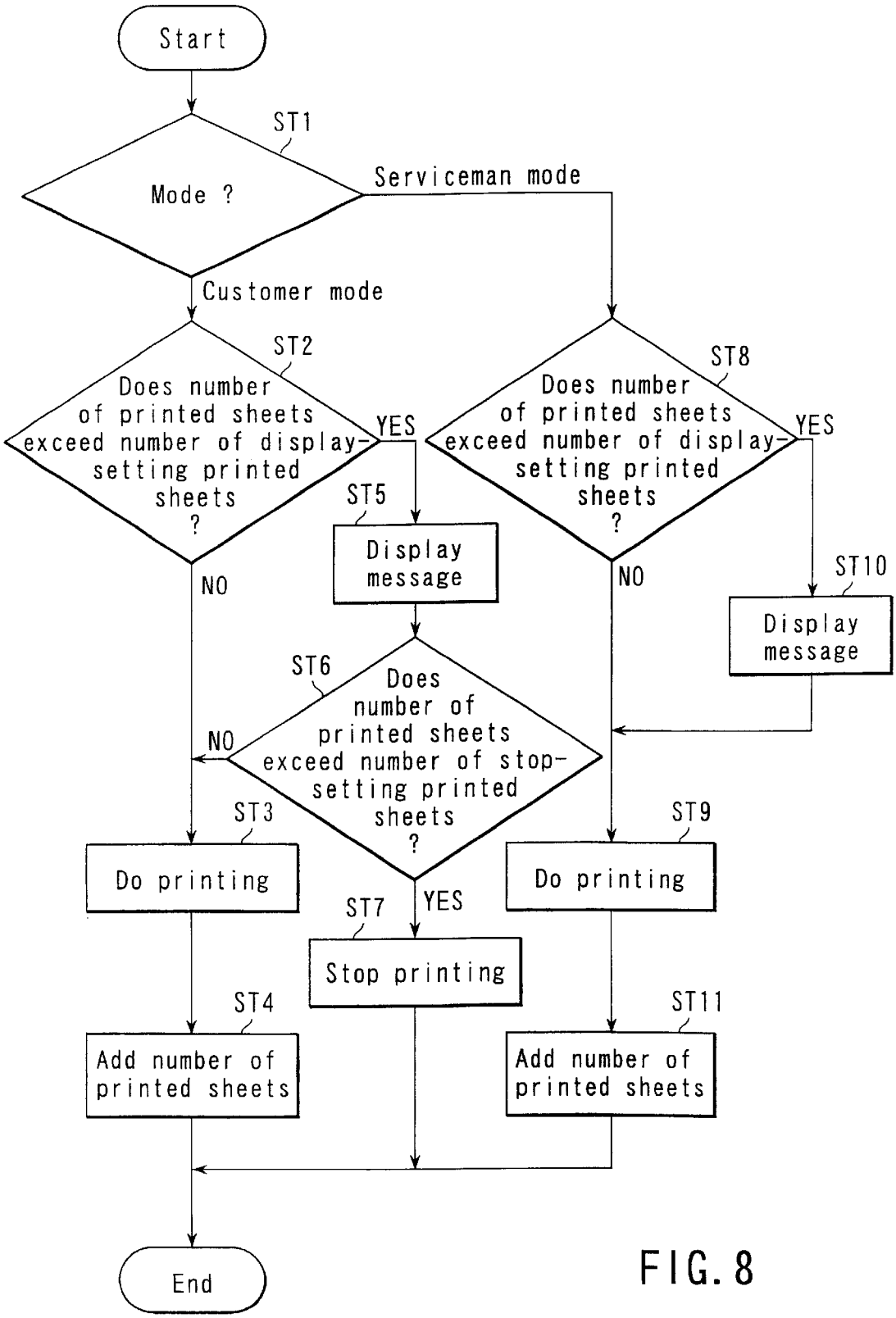
FIG. 8 is a flowchart showing a process to be executed by a CPU of the image forming apparatus according to the first embodiment.

FIG. 8 is a flowchart showing a process to be executed by the CPU 21 when the image forming apparatus 1 performs a printing operation.

First, in step ST1, the CPU 21 determines whether the mode setting section 23*d* sets the customer mode 22*a* or serviceman mode 22*b* when the printing operation is performed.

If the CPU 21 determines that the apparatus is set in the customer mode 22*a*, it determines whether or not the number of printed sheets 23*a* exceeds the number of display-setting printed sheets 23*c* in step ST2. When the CPU 21 determines that the number of printed sheets 23*a* does not exceed the number of display-setting printed sheets 23*c*, it performs a printing operation in step ST3. If the CPU 21 performs the printing operation, it adds the number of printed sheets to the number of printed sheets 23*a* in step ST4 and ends the process.

If the CPU 21 determines that the number of printed sheets 23*a* exceeds the number of display-setting printed sheets 23*c* in step ST2, it displays a process unit replacing message on the display section 24*d* in step ST5.

After that, in step ST6, the CPU 21 determines whether the number of printed sheets 23*a* exceeds the number of stop-setting printed sheets 23*b*. If the CPU 21 determines that the number of printed sheets 23*a* does not exceed the number of stop-setting printed sheets 23*b*, it performs a printing operation in step ST3. If the CPU 21 determines that the number of printed sheets 23*a* exceeds the number of stop-setting printed sheets 23*b*, it stops the printing operation in step ST7 and ends the process.

If the CPU 21 determines that the apparatus is set in the serviceman mode 22*b*, it determines whether the number of printed sheets 23*a* exceeds the number of display-setting printed sheets 23*c* in step ST8. When the CPU 21 determines that the number of printed sheets 23*a* does not exceed the number of display-setting printed sheets 23*c*, it carries out a printing operation in step ST9. When the CPU 21 determines that the number of printed sheets 23*a* exceeds the number of display-setting printed sheets 23*c*, it displays a process unit replacing message on the display section 24*d* in step ST10. In step ST9, the CPU 21 performs the printing operation. If the CPU 21 performs the printing operation, it adds the number of printed sheets to the number of printed sheets 23*a* in step ST10 and ends the process.

A process of resetting the number of printed sheets when the image forming apparatus 1 is set in the serviceman mode 22*b* is executed if the CPU 21 receives a serviceman's operation of the operating panel 24 and resetting the number of printed sheets 23*a* of the RAM 23.

A process of varying the setting of timing at which a process unit replacing message is displayed on the display section 24*d* is executed if the CPU 21 receives the display timing setting key 24*b* and a given input to rewrite the number of display-setting printed sheets 23*c* of the RAM 23. However, the number of display-setting printed sheets 23*c* cannot be set larger than the number of stop-setting printed sheets 23*b* except when the apparatus is set in the serviceman mode 22*b*. Since a serviceman can freely rewrite the number of display-setting printed sheets 23*c*, a user who regards image quality of printing as important can set the number of printing sheets to a relatively small number by which a process unit replacing message can be displayed on the display section 24*d*, with the result that the user can place a quick order for a process unit 15 to shorten a period of time during which the main body of the apparatus stops its printing operation. Since, moreover, the user who regards costs of printing as important can display a process unit replacing message on the display section 24*d* with a delay by a relatively large number of printed sheets, he or she can be relieved of the inconvenience of display.

If the number of printed sheets 23*a* exceeds the number of display-setting printed sheets 23*c* while the image forming apparatus 1 is operating in the serviceman mode 22*b*, a process unit replacing message is displayed on the display section 24*d* every time printing is done. When the user visually identifies the display of the display section 24*d*, he or she contacts, for example, an agency that offers technical service. Then, a service man of the agency visits the user to replace the process unit 15 and operate the operating panel 24 and thus reset the number of printed sheets 23*a*.

The image forming apparatus 1 does not have a function of stopping an operation while the image forming apparatus 1 is operating in the serviceman mode 22*b*. Therefore, even though a process unit replacing message is displayed on the display section 24*d*, the image forming apparatus 1 can do printing despite the fact that the image quality of printing deteriorates for every printing. In order to avoid printing of lower quality than fixed quality, a serviceman makes a contract with users to always make the rounds of users' homes.

The cases where the image forming apparatus 1 is used at remote sites from an agency that offers technical service and in the vicinity of the agency will now be described.

When the image forming apparatus 1 is used at remote sites from an agency, its serviceman operates the mode setting section 23*d* using the mode select key 23*a* to set the apparatus 1 in the customer mode 22*a*. Thus, the agency can send a new process unit 15 to a user without dispatching any serviceman to the user at once when the user informs the agency that a process unit replacing message is displayed. Since the number of printed sheets 23*a* is automatically reset if the user replaces the process unit, the image forming apparatus can be prevented from stopping its printing operation. After that, the serviceman visits the user or the user returns the used process unit 15 to the agency. The serviceman then disassembles the used process unit to replace dead consumable parts and recycle usable ones.

When the image forming apparatus 1 is used in the vicinity of the agency, the serviceman sets the image forming apparatus 1 in the serviceman mode 22*b* from the mode setting section 23*d* using the mode select key 23*a*. The serviceman regularly makes the rounds of users' homes with which he or she makes a contract. When a process unit replacing message is displayed on the display section 24*d*, the serviceman asks a user the quality of print images. If the quality of print images is good, the serviceman operates the keys 24*c* of the operation panel 24 to reset the number of printed sheets 23*a*. The display of the process unit replacing message can also be delayed by adding the number of display-setting printed sheets 23*c* to such an extent that the user can allow the quality of print images. Since the quality of print images depends upon the frequency and environment of use of the image forming apparatus 1, the user can determine the lifetime of the process unit 15 by himself or herself. Since the process unit 15 can be used long, the price per copy can be lowered.

According to the first embodiment, the serviceman can freely set the apparatus in one of the customer mode 22*a* and serviceman mode 22*b* in accordance with the users use environment, etc. Since the serviceman can switch between the two modes in compliance with user's requirements, the apparatus can satisfy a wide spectrum of user's needs.

The process unit 15 can be disassembled as illustrated in FIGS. 2 to 5. It is thus possible to replace only the parts such as the photosensitive drum 2, cleaning blade 7*a*, and seals, which the serviceman has considered to be dead ones from the disassembled parts, and to recycle usable parts. The casing and gears of the process unit 15 are reinforced against a bit insert and deformation due to heat.

Second Embodiment

A second embodiment will now be described. The same components as those of the foregoing embodiment are denoted by the same reference numerals and their detailed descriptions are omitted.

In the second embodiment, a mode setting operation of the mode setting section 23*d* for setting the image forming apparatus 1 in either of the customer mode 22*a* and serviceman mode 22*b* is automatically performed by detecting a mode selecting pin 32 that is provided in the process unit 15 and serves as a fitting section described later.

Figure 9:
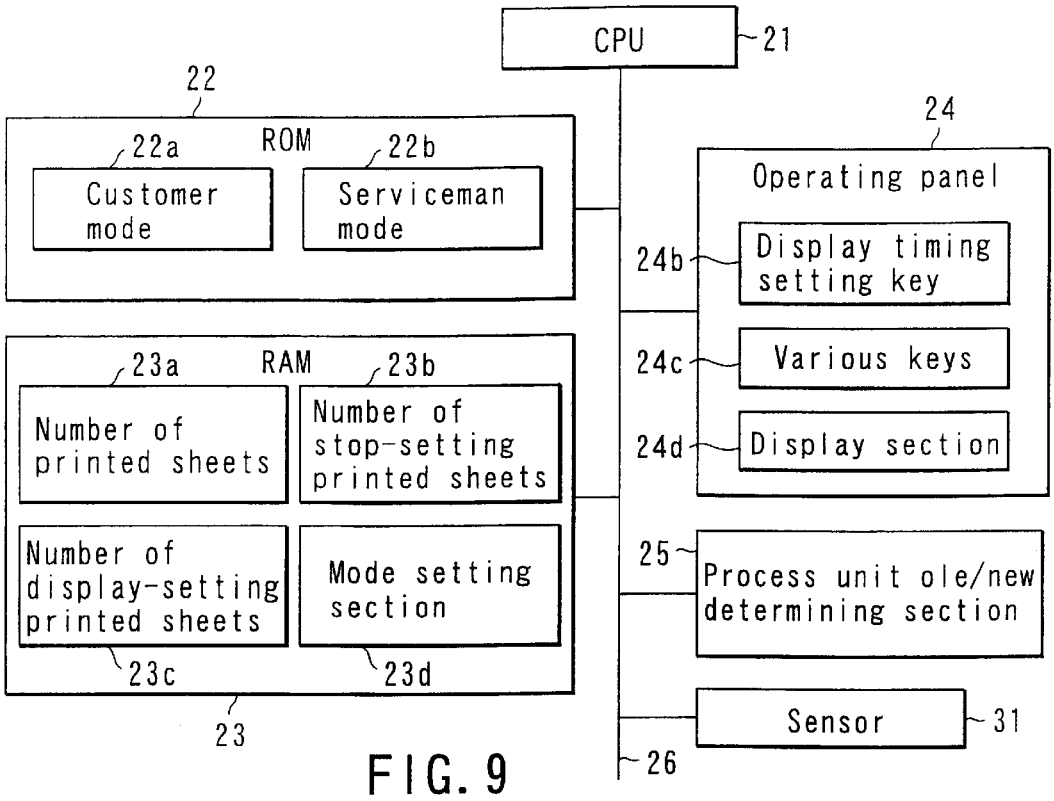
FIG. 9 is a control block diagram showing a main structure of an image forming apparatus according to a second embodiment.

FIG. 9 is a control block diagram showing a main structure of an image forming apparatus 1 according to the second embodiment. As is apparent from FIG. 9, the operating panel 24 does no include the mode select key 23*a* of the image forming apparatus 1 of the first embodiment. Unlike in the first embodiment, a sensor 31 serving as a detecting section, for example, an optical sensor including a light-emitting section 31*a* and a light-receiving section 31b is connected to the bus line 26.

Figure 10:
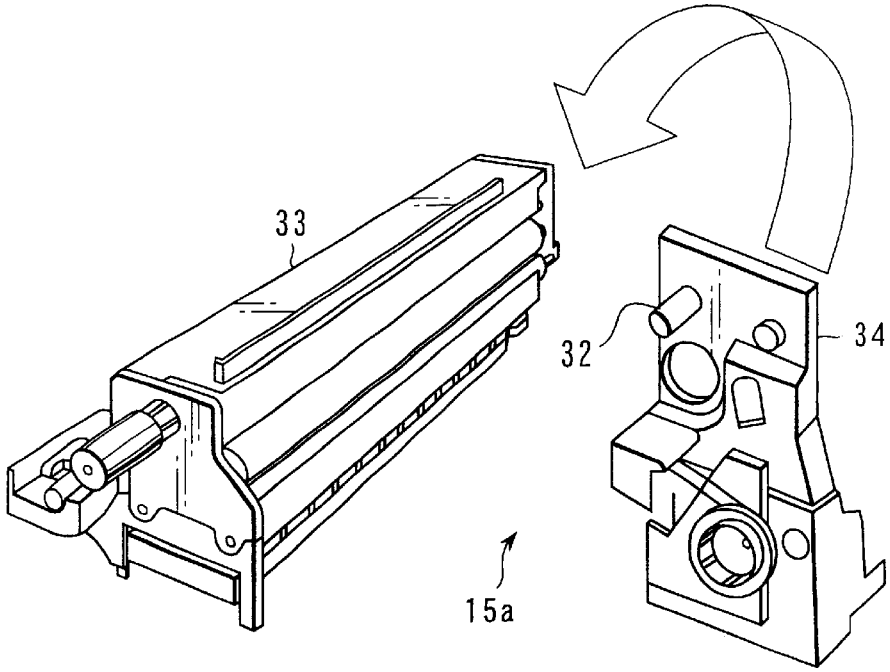
FIG. 10 is a view for explaining a process unit for operating the image forming apparatus according to the second embodiment in serviceman mode.

FIG. 10 is a view for explaining a process unit 15*a* to operate the image forming apparatus 1 in serviceman mode 22*b*. The back of a side frame 34 is matched with that of a process unit main body 33 as indicated by the arrow in the figure. Thus, the side frame 34 is fitted on the process unit main body 33 into the process unit 15*a*. The mode selecting pin 32 is provided in the upper portion of the side frame 34. When the side frame 34 is fitted on the process unit main body 33 and inserted into the image forming apparatus 1, the mode selecting pin 32 projects in the longitudinal direction in the side of the inserting direction.

Figure 11:
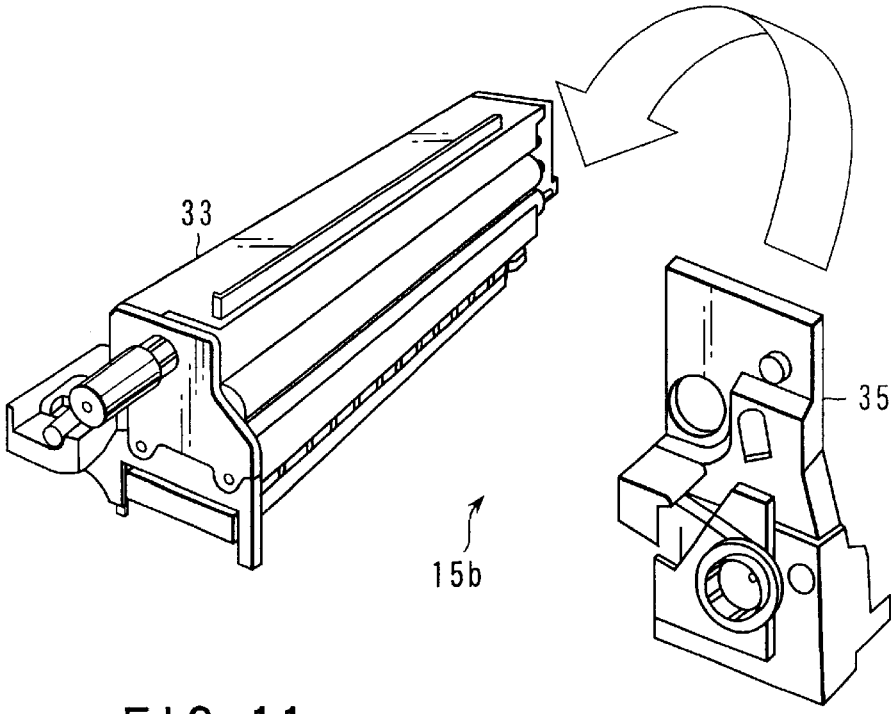
FIG. 11 is a view for explaining a process unit for operating the image forming apparatus according to the second embodiment in customer mode.

FIG. 11 is a view for explaining a process unit 15*b* for operating the image forming apparatus 1 in customer mode 22*a*. The back of a side frame 35 is matched with that of the process unit main body 33 as indicated by the arrow in the figure. Thus, the side frame 35 is fitted into the process unit main body 33 into the process unit 15*b*. Unlike in the side frame 34 described above, the mode selecting pin 32 is not provided in the upper portion of the side frame 35.

Figure 12:
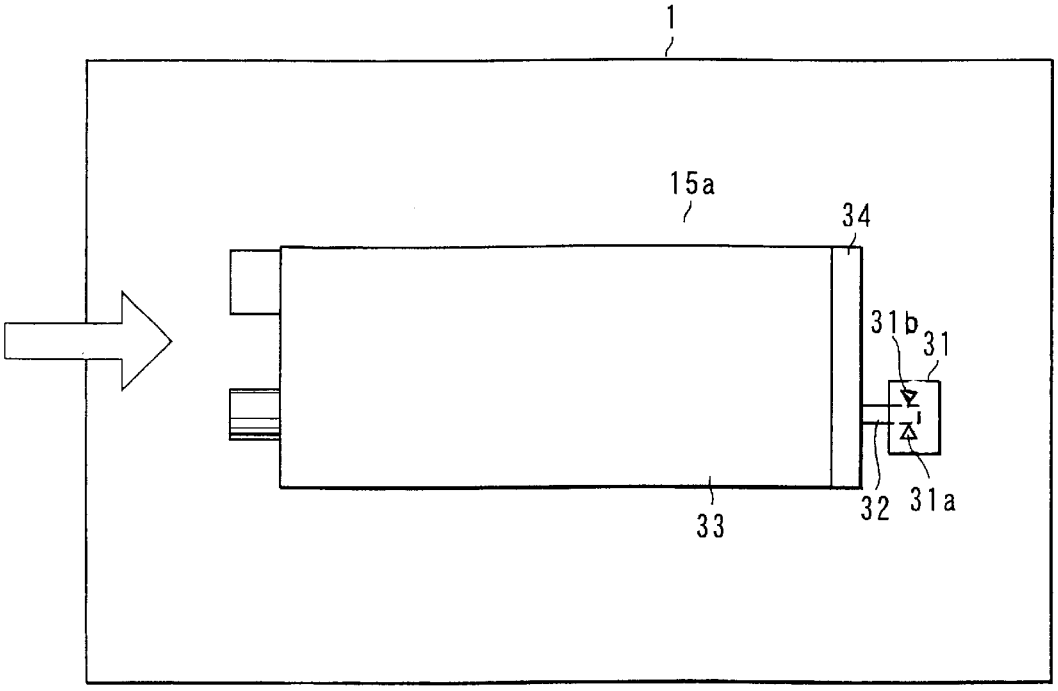
FIG. 12 is a view showing a structure in which the image forming apparatus of the second embodiment detects a serviceman mode from a process unit.

FIG. 12 is a transverse-sectional view for schematically explaining the detection of serviceman mode 22*b* when the process unit 15*a* is inserted into the image forming apparatus 1.

The process unit 15*a* for operating the image forming apparatus in the serviceman mode 22*b* is inserted from the side of the image forming apparatus 1, indicated by the arrow in the figure, in such a manner that the side frame 34 is located in the inner part of the apparatus. The sensor 31 is provided in the innermost part thereof, and the mode selecting pin 32, which projects from the side frame of the inserted process unit 15*a*, is interposed between the light-emitting section 31*a* and light-receiving section 31*b* of the sensor 31. The sensor 31 detects the mode selecting pin 32 and thus the CPU 21 automatically sets the mode setting section 32d in the service mode 22*b*.

When the process unit 15*b* is inserted into the image forming apparatus 1, the sensor 31 does not detect the mode selecting pin 32; therefore, the CPU 21 automatically sets the mode setting section 23*d* in the customer mode 22*a*.

The second embodiment can produce the same advantages as those of the first embodiment.

Even though a serviceman does not set the setting section 23*d*, the image forming apparatus 1 can automatically be operated in either of the serviceman mode 22*b* and customer mode 22*a*. Thus, the serviceman can reduce his or her setting operation and prevent a setting error.

In the second embodiment, the process unit for detecting whether the apparatus is set in either the customer mode 22*a* or serviceman mode 22*b* is shaped so as to detect the mode selecting pin 32 that protrudes in the longitudinal direction in the side of the inserting direction of the process unit 15*a*. Since the mode setting section is provided in the inner part of the apparatus main body, the apparatus can be prevented from malfunctioning when a user touches the apparatus. The shape of the process unit is not limited to the above. The process unit 15*b* for operating the image forming apparatus 1 in the customer mode 22*a* and the process unit 15*a* for operating the image forming apparatus 1 in the serviceman mode 22*b* are different in shape, these different shapes have only to be detected by the image forming apparatus 1.

In the foregoing embodiments, a count value of the amount of use of the process unit 15 corresponds to the number of printed sheets of the process unit 15. However, the amount of use of the process unit 15 can be caused to correspond to the number of revolutions of the photosensitive drum 2 and the exposure time of the exposure unit 4.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a replaceable process unit which holds a photosensitive body and a device to form at least one image;

a holding section which holds the process unit;

a storage section which counts an amount of use of the process unit and stores a count value;

a mode setting section which selectively sets a first mode in which a printing operation stops when the count value reaches a given value and a second mode in which the printing operation does not stop when the count value reaches the given value; and an operating section which sets a mode of the mode setting section.

2. The image forming apparatus according to claim 1, wherein the process unit is disassembled.

3. The image forming apparatus according to claim 1, wherein the operating section resets the count value stored in the storage section.

4. The image forming apparatus according to claim 1, further comprising an old/new determining section which determines whether an inserted process unit is old or new, wherein the count value stored in the storage section is reset when the old/new determining section determines that the inserted process unit is new.

5. The image forming apparatus according to claim 1, wherein the amount of use of the process unit is at least one of a number of printed sheets, a number of revolutions of the photosensitive body, and exposure time.

6. The image forming apparatus according to claim 1, wherein the device held in the process unit includes a charger, a cleaning unit, and a developing unit.

7. An image forming apparatus comprising:

a replaceable process unit which holds a photosensitive body and a device to form at least one image;

a holding section which holds the process unit;

a storage section which counts an amount of use of the process unit and stores a count value;

a mode setting section which selectively sets a first mode in which a printing operation stops when the count value reaches a given value and a second mode in which the printing operation does not stop when the count value reaches the given value; and a detecting section which detects a shape of the process unit and automatically sets a mode.

8. The image forming apparatus according to claim 7, wherein the shape of the process unit corresponds to a fitting section provided in a side of an inserting direction of the process unit.

9. The image forming apparatus according to claim 7, wherein the process unit is disassembled.

10. The image forming apparatus according to claim 7, further comprising an operating section which resets the count value stored in the storage section.

11. The image forming apparatus according to claim 7, further comprising an old/new determining section which determines whether an inserted process unit is old or new, wherein the count value stored in the storage section is reset when the old/new determining section determines that the inserted process unit is new.

12. The image forming apparatus according to claim 7, wherein the amount of use of the process unit is at least one of a number of printed sheets, a number of revolutions of the photosensitive body, and exposure time.

13. The image forming apparatus according to claim 7, wherein the device held in the process unit includes a charger, a cleaning unit, and a developing unit.

14. An image forming apparatus comprising:

a replaceable process unit which holds a photosensitive body and a device to form at least one image;

a holding section which holds the process unit;

a storage section which counts an amount of use of the process unit and stores a count value;

a mode setting section which selectively sets a first mode in which a printing operation stops when the count value reaches a given value and a second mode in which the printing operation does not stop when the count value reaches the given value;

a display section which displays a message to urge a user to replace the process unit when the count value reaches the given value; and an operating section which varies the given value when the message to urge the user to replace the process unit is displayed on the display section.

15. The image forming apparatus according to claim 14, wherein the process unit is disassembled.

16. The image forming apparatus according to claim 14, wherein the operating section resets the count value stored in the storage section.

17. The image forming apparatus according to claim 14, further comprising an old/new determining section which determines whether an inserted process unit is old or new, wherein the count value stored in the storage section is reset when the old/new determining section determines that the inserted process unit is new.

18. The image forming apparatus according to claim 14, wherein the amount of use of the process unit is at least one of a number of printed sheets, a number of revolutions of the photosensitive body, and exposure time.

19. The image forming apparatus according to claim 14, wherein the device held in the process unit includes a charger, a cleaning unit, and a developing unit.

20. A method of operating an image forming apparatus having a process unit that: (i) holds a photosensitive body and a device to form at least one image, and (ii) is replaceably held in a holding section, said method comprising:

counting an amount of use of the process unit and storing a count value;

determining whether a mode selectively set by a mode setting section is a first mode in which a printing operation stops when the count value reaches the given value or a second mode in which the printing operation does not stop when the count value reaches the given value; and setting a mode of the mode setting section by an operating section.

21. The method according to claim 20, wherein the process unit is disassembled.

22. The method according to claim 20, further comprising resetting the count value stored in the storage section by the operating section.

23. The method according to claim 20, further comprising resetting the count value stored in the storage section when an old/new determining section, which determines whether an inserted process unit is old or new, determines that the inserted process unit is new.

24. The method according to claim 20, wherein the amount of use of the process unit is at least one of a number of printed sheets, a number of revolutions of the photosensitive body, and exposure time.

25. The method according to claim 20, wherein the device held in the process unit includes a charger, a cleaning unit, and a developing unit.

26. A method of operating an image forming apparatus having a process unit that: (i) holds a photosensitive body and a device to form at least one image, and (ii) is replaceably held in a holding section, said method comprising:

counting an amount of use of the process unit and storing a count value;

determining whether a mode selectively set by a mode setting section is a first mode in which a printing operation stops when the count value reaches the given value or a second mode in which the printing operation does not stop when the count value reaches the given value; and detecting a shape of the process unit and automatically setting a mode in accordance with the detected shape.

27. The method according to claim 26, wherein the shape of the process unit corresponds to a fitting section provided in a side of an inserting direction of the process unit.

28. The method according to claim 26, wherein the process unit is disassembled.

29. The method according to claim 26, further comprising resetting the count value stored in the storage section by an operating section.

30. The method according to claim 26, further comprising resetting the count value stored in the storage section when an old/new determining section, which determines whether an inserted process unit is old or new, determines that the inserted process unit is new.

31. The method according to claim 26, wherein the amount of use of the process unit is at least one of a number of printed sheets, a number of revolutions of the photosensitive body, and exposure time.

32. The method according to claim 26, wherein the device held in the process unit includes a charger, a cleaning unit, and a developing unit.

33. A method of operating an image forming apparatus having a process unit that: (i) holds a photosensitive body and a device to form at least one image, and (ii) is replaceably held in a holding section, said method comprising:

counting an amount of use of the process unit and storing a count value;

determining whether a mode selectively set by a mode setting section is a first mode in which a printing operation stops when the count value reaches the given value or a second mode in which the printing operation does not stop when the count value reaches the given value; and displaying a message to urge a user to replace the process unit on a display section when the count value reaches the given value which can be varied by an operating section.

34. The method according to claim 33, wherein the process unit is disassembled.

35. The method according to claim 33, further comprising resetting the count value stored in the storage section by the operating section.

36. The method according to claim 33, further comprising resetting the count value stored in the storage section when an old/new determining section, which determines whether an inserted process unit is old or new, determines that the inserted process unit is new.

37. The method according to claim 33, wherein the amount of use of the process unit is at least one of a number of printed sheets, a number of revolutions of the photosensitive body, and exposure time.

38. The method according to claim 33, wherein the device held in the process unit includes a charger, a cleaning unit, and a developing unit.

* * * * *